US011268222B2

(12) United States Patent
Tanaka

(10) Patent No.: US 11,268,222 B2
(45) Date of Patent: Mar. 8, 2022

(54) SEWING MACHINE

(71) Applicant: JUKI CORPORATION, Tokyo (JP)

(72) Inventor: Hiroyuki Tanaka, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 106 days.

(21) Appl. No.: 16/797,543

(22) Filed: Feb. 21, 2020

(65) Prior Publication Data

US 2020/0270788 A1 Aug. 27, 2020

(30) Foreign Application Priority Data

Feb. 26, 2019 (JP) ..... JP2019-032248

(51) Int. Cl.

| | |
|---|---|
| ***D05B 19/14*** | (2006.01) |
| ***D05B 19/08*** | (2006.01) |
| ***D05B 19/10*** | (2006.01) |
| ***D05B 39/00*** | (2006.01) |

(52) U.S. Cl.

CPC ..... *D05B 19/14* (2013.01); *D05B 19/08* (2013.01); *D05B 19/10* (2013.01); *D05B 39/00* (2013.01)

(58) Field of Classification Search

CPC ..... D05C 9/22; D05B 19/14; D05B 19/08; D05B 19/10; D05B 39/00

See application file for complete search history.

(56) References Cited

U.S. PATENT DOCUMENTS

| | | | | |
|---|---|---|---|---|
| 5,537,945 | A | 7/1996 | Sugihara | |
| 8,061,286 | B2 * | 11/2011 | Hirata | D05C 5/04 112/470.01 |
| 8,594,830 | B2 * | 11/2013 | Tokura | D05B 19/08 700/137 |
| 8,596,209 | B2 * | 12/2013 | Fujihara | D05B 55/10 112/470.05 |
| 2006/0137582 | A1 * | 6/2006 | Kawabe | D05B 19/04 112/102.5 |
| 2010/0236463 | A1 * | 9/2010 | Fujihara | D05C 11/06 112/470.05 |

(Continued)

FOREIGN PATENT DOCUMENTS

| | | |
|---|---|---|
| EP | 2 233 627 A2 | 9/2010 |
| EP | 2 292 825 A2 | 3/2011 |
| JP | 2017-192530 A | 10/2017 |

OTHER PUBLICATIONS

Extended European Search Report dated Aug. 26, 2020 issued for European Patent Application No. 20 15 9236.7.

*Primary Examiner* — Tajash D Patel
(74) *Attorney, Agent, or Firm* — Pearne & Gordon LLP

(57) ABSTRACT

Provided is a sewing machine in which a stitching needle and a holding frame holding an article to be sewn are positioned relative to each other based on sewing pattern data defining a plurality of needle drop positions, and sewing is performed in accordance with a sewing pattern. The sewing machine includes: an imager for capturing an image of the holding frame; a position detector for detecting, from the image captured by the imager, the position of an indicator indicating a reference position marked in an object to be imaged; and a corrector which, based on a deviation of a detected position of the indicator detected by the position detector with respect to a regular position defined in advance for the indicator, corrects a plurality of needle drop positions defined in the sewing pattern data.

8 Claims, 7 Drawing Sheets

(56) References Cited

U.S. PATENT DOCUMENTS

| | | | | |
|---|---|---|---|---|
| 2010/0242817 | A1 | 9/2010 | Tokura | |
| 2011/0048300 | A1 | 3/2011 | Tokura | |
| 2018/0057985 | A1* | 3/2018 | Imaizumi | D05B 19/10 |

* cited by examiner

SEWING MACHINE

CROSS-REFERENCE TO RELATED APPLICATION

This application claims priority from Japanese Patent Application No. 2019-032248 filed with the Japan Patent Office on Feb. 26, 2019, the entire content of which is hereby incorporated by reference.

BACKGROUND

1. Technical Field

The present invention relates to a sewing machine which lowers a sewing needle at preset needle drop positions in sequence.

2. Related Art

As a sewing machine which lowers a sewing needle at preset needle drop positions in sequence, an electronic cycle sewing machine is known. The electronic cycle sewing machine performs sewing on the basis of sewing pattern data in which a plurality of needle drop positions and their sequence with respect to a fabric are defined, in accordance with a predetermined sewing pattern while moving the fabric with each stitch (see JP-A-2017-192530, for example).

SUMMARY

In a sewing machine according to an embodiment of the present disclosure is a sewing machine, a stitching needle and a holding frame holding an article to be sewn are positioned relative to each other based on sewing pattern data defining a plurality of needle drop positions, and sewing is performed in accordance with a sewing pattern. The sewing machine includes: an imager for capturing an image of the holding frame; a position detector for detecting, from the image captured by the imager, the position of an indicator indicating a reference position marked in an object to be imaged; and a corrector which, based on a deviation of a detected position of the indicator detected by the position detector with respect to a regular position defined in advance for the indicator, corrects a plurality of needle drop positions defined in the sewing pattern data.

DETAILED DESCRIPTION

Figure 1:
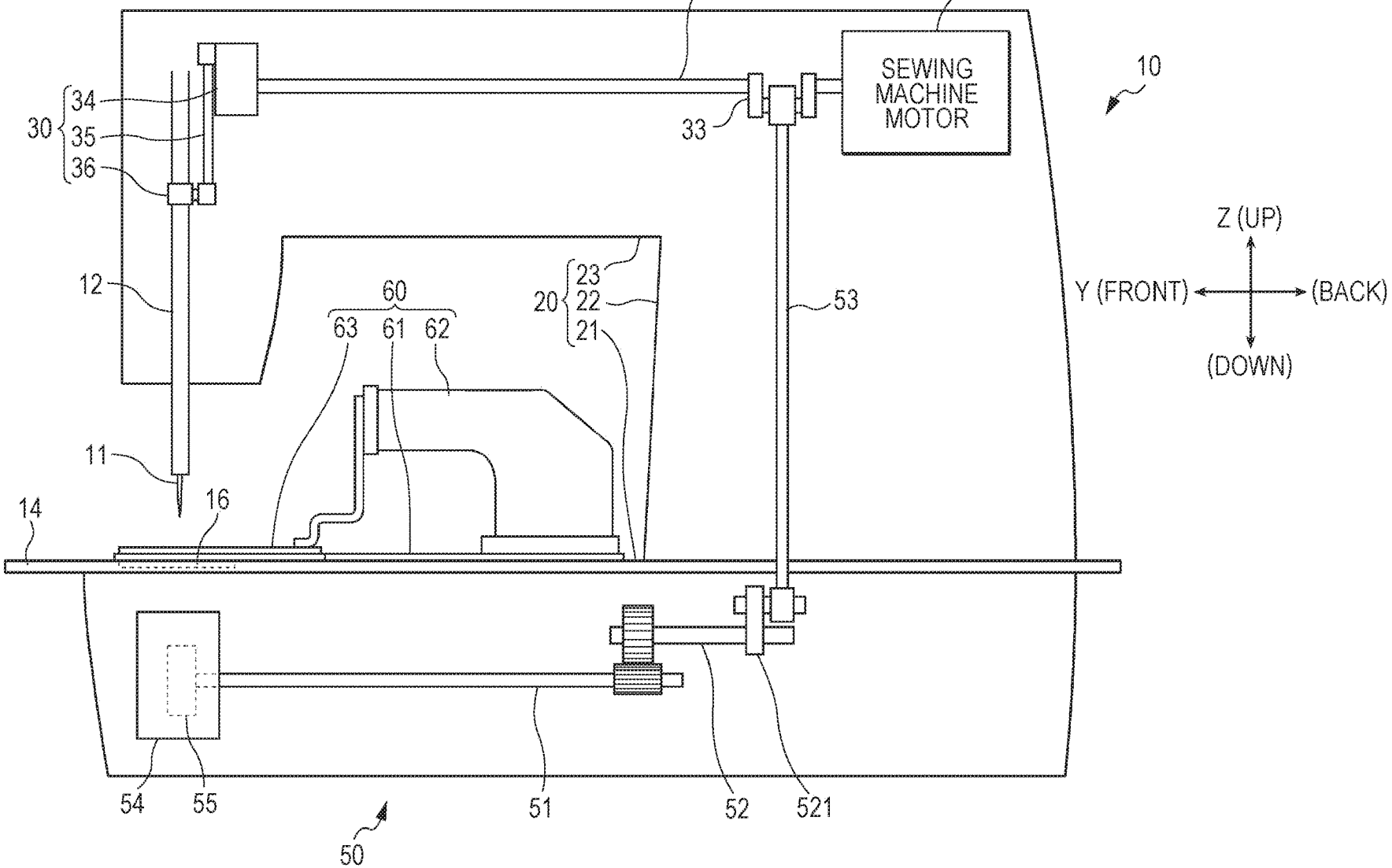
FIG. 1 is a schematic configuration diagram of a sewing machine according to an embodiment of the present invention.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the electronic cycle sewing machine noted above, sewing may be performed where a fabric is interposed in a jig having openings formed in correspondence to a sewing pattern, and the jig is set in a cloth holding frame for holding the fabric. By preparing a plurality of such jigs and setting fabric in all the jigs in advance, it is possible to perform sewing efficiently, compared to when fabric is set directly in the cloth holding frame.

However, when the jig is set in the cloth holding frame, an error may be caused in mount position or orientation, resulting in a failure to perform sewing appropriately in accordance with the sewing pattern, or causing variations in stitching quality from one fabric to another.

Further, even when the jig is not used, if the position or orientation of the sewing pattern with respect to fabric is determined in advance, similar problems may occur if the fabric is erroneously orientated or positioned during the setting of the fabric in the cloth holding frame.

An object of the present invention is to perform sewing at an appropriate needle drop position.

An invention according to claim 1 is a sewing machine in which a stitching needle and a holding frame holding an article to be sewn are positioned relative to each other based on sewing pattern data defining a plurality of needle drop positions, and sewing is performed in accordance with a sewing pattern. The sewing machine includes: an imager for capturing an image of the holding frame; a position detector for detecting, from the image captured by the imager, the position of an indicator indicating a reference position marked in an object to be imaged; and a corrector which, based on a deviation of a detected position of the indicator detected by the position detector with respect to a regular position defined in advance for the indicator, corrects a plurality of needle drop positions defined in the sewing pattern data.

An invention according to claim 2 is the sewing machine according to claim 1, in which: the position detector detects the positions of a plurality of the indicators from the captured image; and the corrector corrects the plurality of needle drop positions, defined in the sewing pattern data, based on the deviation of the detected positions of the plurality of indicators.

An invention according to claim 3 is the sewing machine according to claim 2, in which the corrector performs position correction and angle correction for the plurality of needle drop positions, defined in the sewing pattern data, on the basis of the deviation of the detected positions of the plurality of indicators.

An invention according to claim 4 is the sewing machine according to any one of claims 1 to 3, the sewing machine including a jig for holding the article to be sewn, and the holding frame holds the article to be sewn via the jig.

An invention according to claim 5 is the sewing machine according to any one of claims 1 to 4, in which the position detector detects the position of the indicator attached to the article to be sewn or the holding frame from the captured image.

An invention according to claim 6 is the sewing machine according to claim 4, in which the position detector detects the position of the indicator attached to the jig from the captured image.

According to the present invention, even when an error is caused in the mount position or orientation of a jig or an article to be sewn, it is possible to sew the article to be sewn appropriately in accordance with a sewing pattern.

Outline of an Embodiment of the Invention

Figure 2:
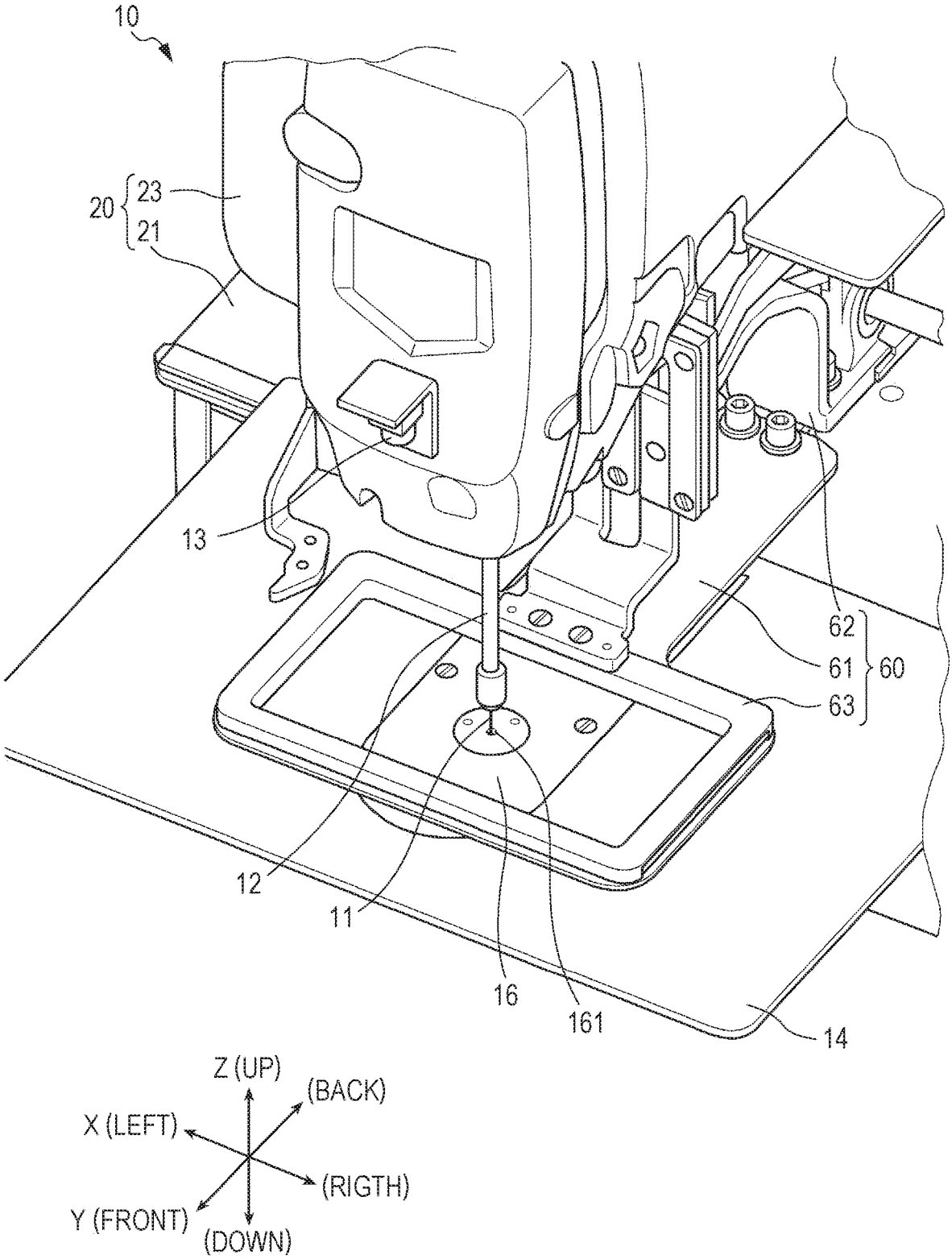
FIG. 2 is a perspective view around a throat plate of the sewing machine.
Figure 3:
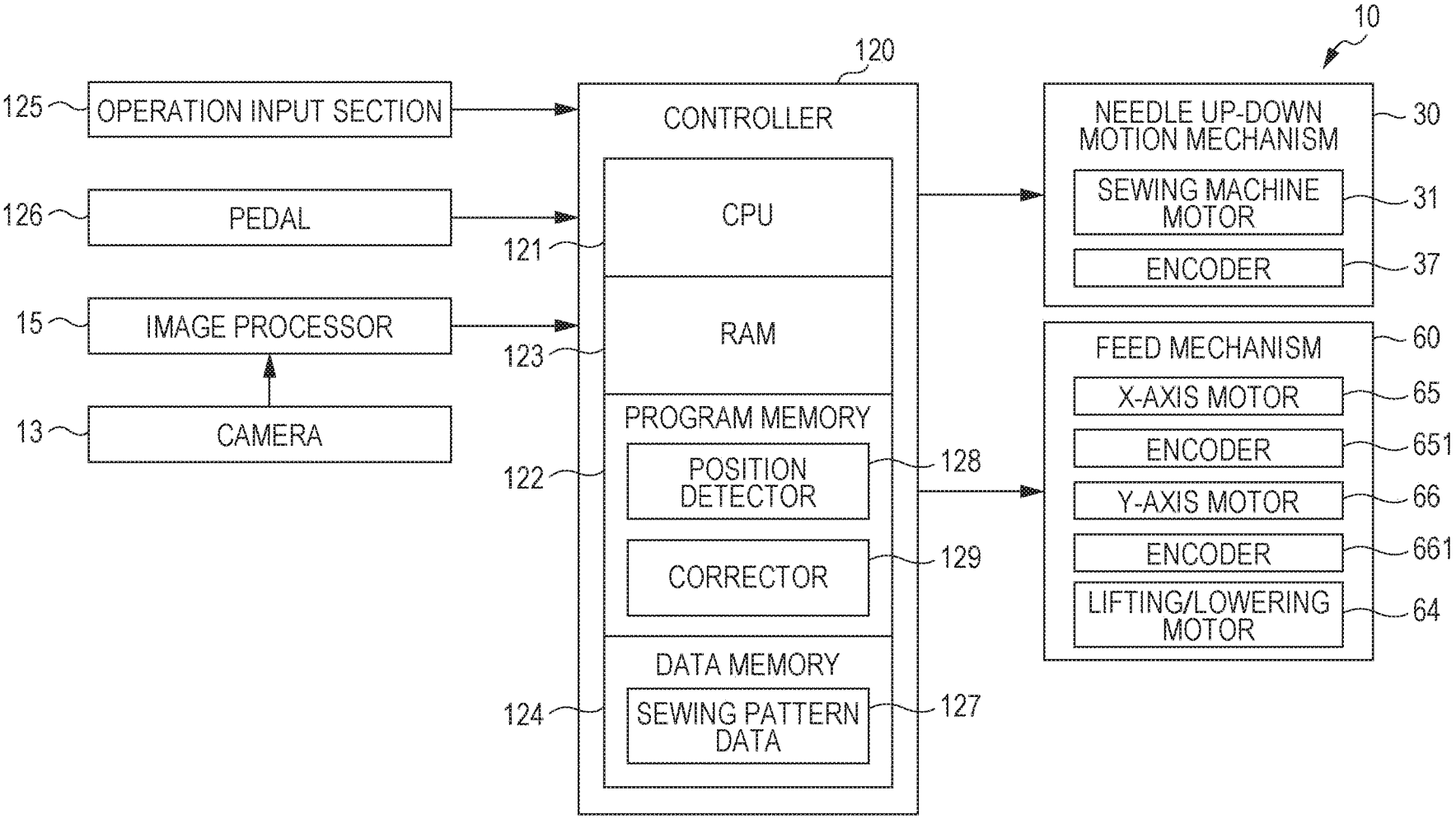
FIG. 3 is a block diagram of a control system of the sewing machine.

In the following, an embodiment of the present invention will be described in detail with reference to FIG. 1 to FIG. 7. FIG. 1 is a schematic configuration diagram of a sewing machine 10 of the present embodiment. FIG. 2 is a perspective view around a throat plate of the sewing machine 10. FIG. 3 is a block diagram of a control system.

The sewing machine 10 is a so-called electronic cycle sewing machine, and is provided with: a sewing machine frame 20; a needle up-down motion mechanism 30 for causing a needle bar 12 holding a stitching needle 11 to move up and down; a throat plate 16 disposed in a needle drop position of a sewing machine bed 21 of the sewing machine frame 20; a shuttle mechanism 50 for intertwining an upper thread of the stitching needle 11 with a lower thread under the throat plate 16; a feed mechanism 60 serving as a moving mechanism for causing a cloth K, which is an article to be sewn, to be moved as desired along an X-Y plane with respect to the stitching needle 11; and a controller 120 for controlling the operation of the respective elements.

A detailed description of a thread cutter, a thread tensioner, a thread take-up lever, an inner presser mechanism and the like is omitted as they are known mechanisms with which sewing machines are generally equipped.

In the following, the individual elements will be described in sequence.

[Sewing Machine Frame]

As illustrated in FIG. 1, the sewing machine frame 20 includes: the sewing machine bed 21 located underneath; a sewing machine vertical body 22 rising from one end of the sewing machine bed 21; and a sewing machine arm 23 extending from the top of the sewing machine vertical body 22 along the sewing machine bed 21.

In the following description of the configuration of the sewing machine 10, the up-down motion direction of the needle bar 12, as will be described later, is defined as the Z-axis direction; a direction orthogonal to the Z-axis direction and parallel to the longitudinal direction of the sewing machine bed 21 and the sewing machine arm 23 is defined as the Y-axis direction; and a direction orthogonal to both the Z-axis direction and the Y-axis direction is defined as the X-axis direction.

When the sewing machine 10 is installed on a horizontal surface, the Z-axis direction is the vertical, up-down direction, and the X-axis direction and the Y-axis direction are horizontal directions.

One side in the Y-axis direction that is on the face side of the sewing machine frame 20 is defined as "front". The side opposite to the front side is defined as "back". One side in the X-axis direction that is on the left-hand side when facing the face is defined as "left", and the right-hand side is defined as "right". The vertically upper side in the Z-axis direction is defined as "up", and the opposite side is defined as "down".

A horizontal work base 14 is disposed on the front-end top of the sewing machine bed 21. The throat plate 16 has a needle hole 161 formed therein, and is flush-mounted in the needle drop position of the horizontal work base 14.

Inside the front end of the sewing machine arm 23, an upper shaft 32 (main shaft) is oriented in parallel with the longitudinal direction (Y-axis direction) of the sewing machine arm 23 and is rotatably supported.

Inside the sewing machine bed 21, a lower shaft 51 oriented in parallel with the longitudinal direction (Y-axis direction) is rotatably supported.

[Needle Up-Down Motion Mechanism]

As illustrated in FIG. 1, the needle up-down motion mechanism 30 is provided with: a sewing machine motor 31 including a servo motor and disposed at the top of the sewing machine vertical body 22; the upper shaft 32, which is connected to an output shaft of the sewing machine motor 31 and is rotated; a needle bar crank 34 secured to the end of the upper shaft 32 on the face side of the sewing machine; a crank rod 35 of which one end is coupled with the needle bar crank 34 at a location offset from the center of rotation of the upper shaft 32; and the needle bar 12, which is coupled with the other end of the crank rod 35 via a needle bar-connecting stud 36.

The needle bar 12 holds the stitching needle 11 at the lower end thereof, and is supported on the sewing machine arm 23 so as to be movable up and down in a reciprocating manner along the Z-axis direction.

The sewing machine motor 31 is a servo motor and is provided with an encoder 37 (see FIG. 3). The controller 120 detects from the encoder 37 the rotational speed, upper shaft angle and the like of the sewing machine motor 31, and implements an operation control with respect to the sewing machine motor 31.

A detailed description of the configurations of the needle bar crank 34, the crank rod 35, the needle bar-connecting stud 36 and the like is omitted as they are similar to those that are well known.

[Feed Mechanism]

As illustrated in FIG. 1 to FIG. 3, the feed mechanism 60 causes the cloth K to be moved along the horizontal upper surface of the throat plate 16, and determines the moving position of the cloth K as desired with respect to the stitching needle 11.

Accordingly, the feed mechanism 60, on the upper surface of the sewing machine bed 21, is provided with: a lower plate 61 and a base 62 which are supported so as to be movable along the X-axis direction and the Y-axis direction; a cloth presser 63 which is supported by the base 62 in a liftable and lowerable manner, and holds, from above the lower plate 61, the cloth K or a jig 40 which will be described later; a lifting/lowering motor 64 for lifting and lowering the cloth presser 63; an X-axis motor 65 which is a drive source for causing, via the base 62, the cloth presser 63 to be moved along the X-axis direction; and a Y-axis motor 66 which is a drive source for causing, via the base 62, the cloth presser 63 to be moved along the Y-axis direction.

The lower plate 61 and the cloth presser 63 function as a holding frame.

The lower plate 61 is an elongated flat plate disposed along the X-Y plane. The front end of the lower plate 61 has a rectangular frame shape with a wide central opening.

The base 62 rises from the back end side on the upper surface of the lower plate 61. The base 62 and the lower plate 61 move together with the cloth presser 63 along the X-Y plane.

The cloth presser 63 supported by the base 62 is disposed on the upper side on the front end of the lower plate 61. The cloth presser 63 also has a rectangular frame shape, and is supported so as to be liftable and lowerable along an elongate hole formed in the front end of the base 62. The lower plate 61 and the cloth presser 63 can be overlapped with their respective openings substantially aligned with each other, where sewing is performed inside the aligned opening. The base 62 is equipped with a lifting and lowering lever, not illustrated, of which the distal end is caused to move pivotally up and down by the lifting/lowering motor 64. The cloth presser 63 engages with the distal end of the lifting and lowering lever so as to be lifted and lowered.

The X-axis motor 65 and the Y-axis motor 66 are both stepping motors, of which the amount of operation is controlled by the controller 120. The sewing machine bed 21 houses a well-known transmission mechanism for converting the torque of each of the X-axis motor 65 and the Y-axis motor 66 respectively into a linear motion in the X-axis direction and the Y-axis direction. Linear motions in the X-axis direction and the Y-axis direction are transmitted from the X-axis motor 65 and the Y-axis motor 66 to the base 62 and the lower plate 61.

[Jig]

Figure 4:
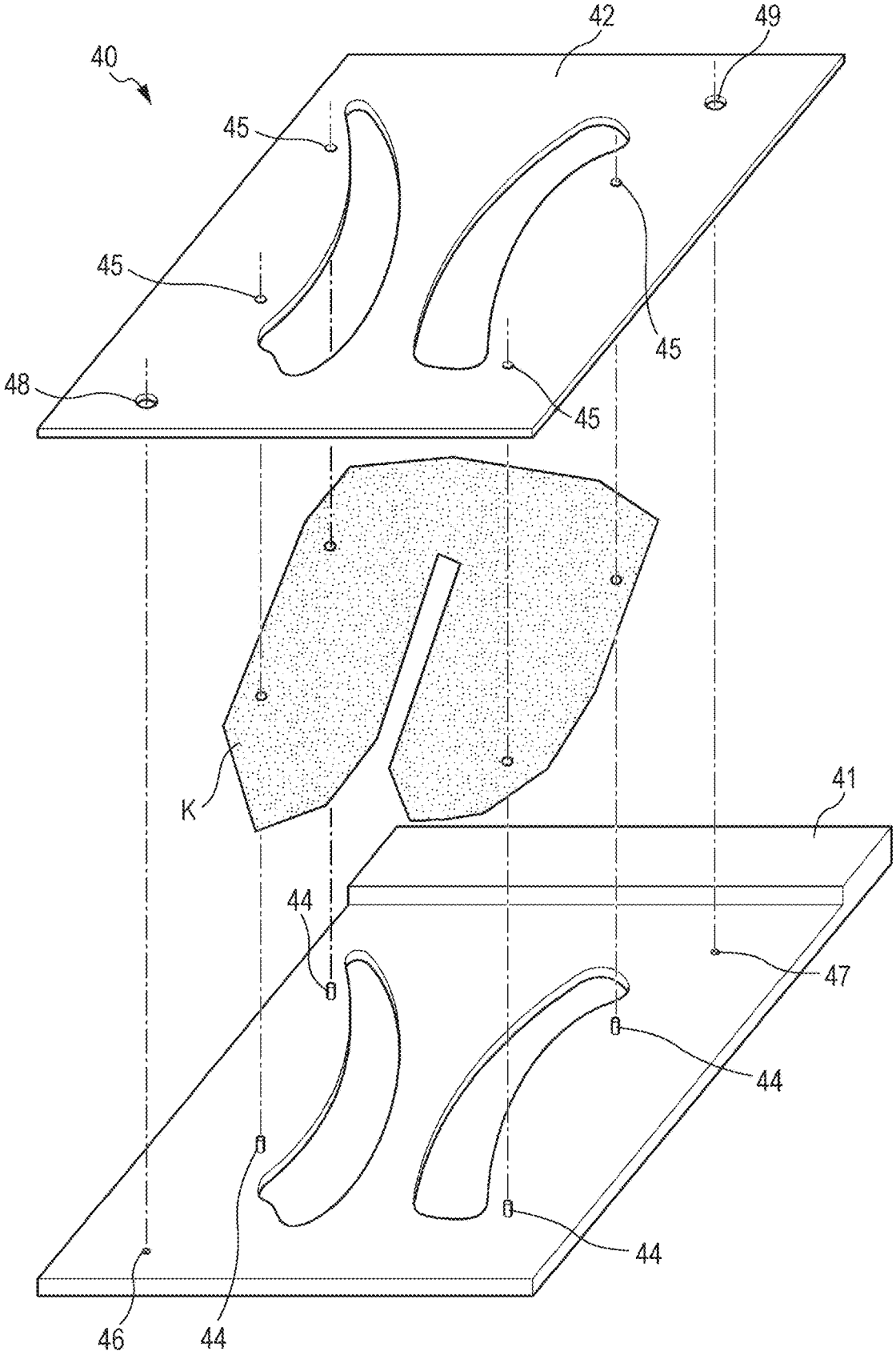
FIG. 4 is an exploded perspective view of a jig.
Figure 5A:
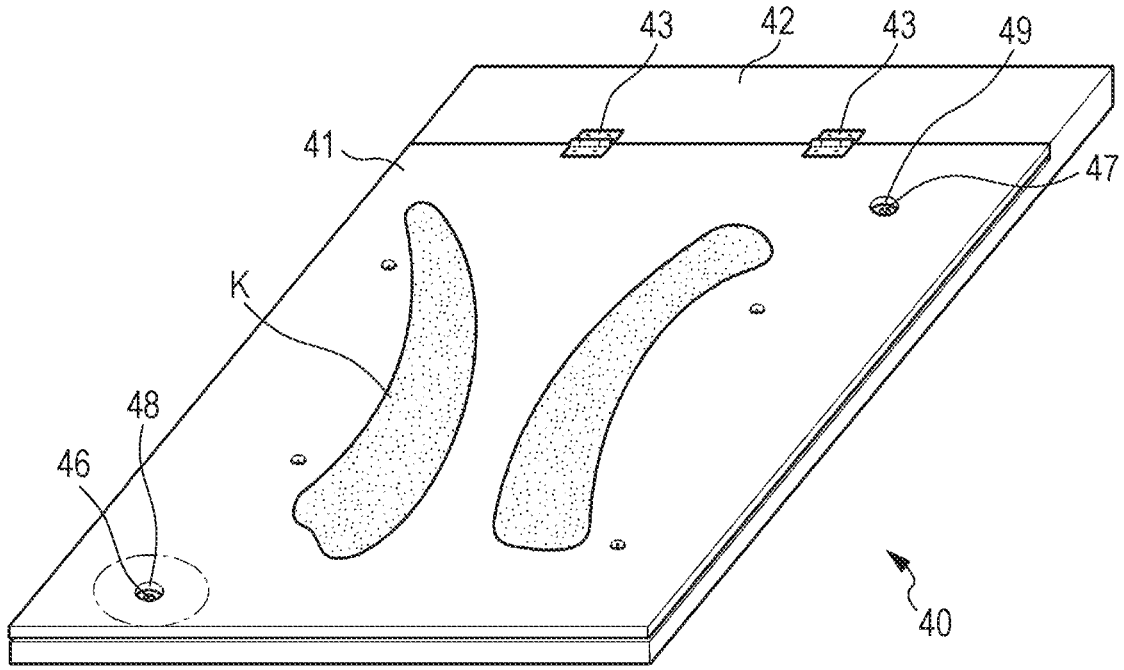
FIG. 5A is a perspective view of the jig.
Figure 5B:
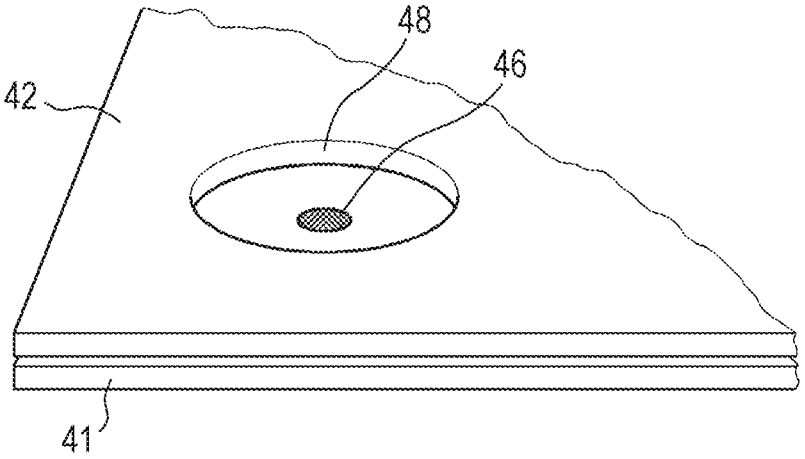
FIG. 5B is an enlarged perspective view of the jig.

FIG. 4 is an exploded perspective view of the jig 40, FIG. 5A is a perspective view of the jig 40, and FIG. 5B is an enlarged perspective view of the jig 40.

The jig 40 is a jig for attaching the cloth K. The jig 40 holds the cloth K and makes it possible to attach and detach the cloth K between the lower plate 61 and the cloth presser 63 of the feed mechanism 60. A plurality of jigs 40 is prepared, and by setting the cloth K in each jig 40 in advance, it is possible to perform sewing with respect to a plurality of cloths K successively and efficiently.

The jig 40 is provided with a first flat plate 41 and a second flat plate 42 disposed over the first flat plate 41. One end of the second flat plate 42 is supported with hinges 43 (not illustrated in FIG. 4) in a pivotally rotatable manner so as to rise and fall with respect to the first flat plate 41.

The first flat plate 41 and the second flat plate 42 have respective openings which are formed so as to align when overlapped, the openings having the shape of a sewing pattern defined in sewing pattern data 127. During sewing, the needle is moved downward so as to form the sewing pattern inside the openings. In this way, compared to when the cloth K is held directly by the lower plate 61 and the cloth presser 63, it is possible to hold the cloth K at locations close to the needle drop position. Thus, it is possible to suppress unwanted movement of the cloth K due to downward movement of the needle, and to perform high-quality sewing.

On an upper surface of the first flat plate 41, a plurality of positioning projections 44 is disposed. The second flat plate 42 has positioning holes 45 penetrating therethrough at positions respectively corresponding to the positioning projections 44. The positioning holes 45 are not limited to the through-holes and may include recesses.

The cloth K also has a plurality of penetrating through-holes formed therein to pass the positioning projections 44, so that the cloth K can be positioned and set with respect to the respective positioning projections 44 of the first flat plate 41.

With the cloth K interposed, the first flat plate 41 and the second flat plate 42 are held between the lower plate 61 and the cloth presser 63 and are thereby mounted onto the feed mechanism 60, and then sewing can be performed in this state.

On the upper surface of the first flat plate 41, a first reference mark 46 and a second reference mark 47 serving as indicators of reference positions for the jig 40 are also disposed at positions diagonally spaced apart from each other. The second flat plate 42 has penetrating through-holes 48, 49 formed therein so as not to block the first reference mark 46 and the second reference mark 47 from above.

[Shuttle Mechanism]

The shuttle mechanism 50 includes a half rotary shuttle and is provided with: a middle shuttle, not illustrated, which rotates in a reciprocating manner inside a large shuttle 54 in synchronism with the up-down motion of the needle bar 12; a bobbin and a bobbin case, not illustrated, which are housed inside the middle shuttle; a driver 55 which causes the middle shuttle to rotate in a reciprocating manner; a crank rod 53 of which one end is coupled to a crank 33 formed on the upper shaft 32; a reciprocating rotational shaft 52 with an arm 521 coupled to the other end of the crank rod 53; and a lower shaft 51 which rotates in a reciprocating manner with a speed increased by the reciprocating rotational shaft 52. The lower shaft 51 causes the middle shuttle to rotate in a reciprocating manner via the driver 55. The sewing machine motor 31 mentioned above provides a drive source for the up-down motion of the needle bar 12 and the rotational operation of the shuttle mechanism 50. The middle shuttle rotates in a reciprocating manner at the same period as the upper shaft 32, and the upper thread is intertwined with the lower thread as the stitching needle 11 moves up and down and the shuttle mechanism 50 rotates. A detailed description of the structure and configuration of the half rotary shuttle is omitted as they are well known.

[Sewing Machine Control System]

As illustrated in FIG. 3, the controller 120 is generally configured of: a program memory 122 in which various control programs are stored or saved; a CPU 121 which performs various computing processes in accordance with the various programs; a RAM 123 which is used as a working memory for various processes, and a data memory 124 in which various sewing data and setting data are stored.

The controller 120 is connected, via a system bus, an interface, a drive circuit and the like which are not illustrated, with the sewing machine motor 31 and the encoder 37 of the needle up-down motion mechanism 30, and the X-axis motor 65, encoder 651, the Y-axis motor 66, an encoder 661, the lifting/lowering motor 64 and the like of the feed mechanism 60.

The encoder 37 detects the shaft angle of the output shaft of the sewing machine motor 31. The encoder 651 detects the shaft angle of the output shaft of the X-axis motor 65. The encoder 661 detects the shaft angle of the output shaft of the Y-axis motor 66.

The controller 120 is also connected with an operation input section 125 for inputting various settings concerning sewing, and with a pedal 126 as a means for inputting a signal for performing sewing, for example.

On the operation input section 125, various command settings are made, such as the number of stitches and the needle drop position in the sewing pattern data 127.

The pedal 126 is stepped on, for example, to input an instruction for starting sewing.

As illustrated in FIG. 2, a camera 13 serving as an imager is disposed on the front face of the sewing machine arm 23, with an optical axis of the camera facing downward. The camera 13 is able to capture an image of the cloth presser 63 as a whole around the throat plate 16, or the jig 40 as a whole being held by the cloth presser 63.

Image data captured by the camera 13 is input to an image processing device 15. The image processing device 15 is also connected to the controller 120.

[Basic Sewing Operation Control During Sewing]

When driving of the sewing machine motor 31 starts, the controller 120 performs a basic sewing operation control in which a needle drop position is read from the sewing pattern data 127 at a prescribed upper shaft angle for each stitch on the basis of an output from the encoder 37, and the X-axis motor 65 and the Y-axis motor 66 are controlled so as to position the lower plate 61 and the cloth presser 63 so that the needle is lowered at the needle drop position read from the sewing pattern data 127. Then, needle lowering is performed in sequence for all of the numbers of stitches defined in the sewing pattern data 127, and sewing is performed in accordance with the sewing pattern defined in the sewing pattern data 127.

[Sewing Pattern Data Correction Process]

The controller 120, when the cloth K has been set between the lower plate 61 and the cloth presser 63 using the jig 40 and before sewing is started, performs a correction process for position coordinate data indicating all needle drop positions for forming the sewing pattern defined in the sewing pattern data 127, on the basis of a mounting error of the jig 40.

That is, the CPU 121 of the controller 120 executes a program in the program memory 122 that is to be caused to function as a position detector 128, and thereby detects, from an image captured by the camera 13 and in cooperation with the image processing device 15, the positions of the first reference mark 46 and the second reference mark 47 indicating the reference positions marked in an object to be imaged.

The CPU 121 also executes a program in the program memory 122 that is to be caused to function as a corrector 129, and thereby corrects a plurality of needle drop positions defined in the sewing pattern data 127, on the basis of a deviation in the detected positions of the first reference mark 46 and the second reference mark 47 detected by the process of the position detector 128 with respect to regular positions defined in advance for the first reference mark 46 and the second reference mark 47.

Figure 6:
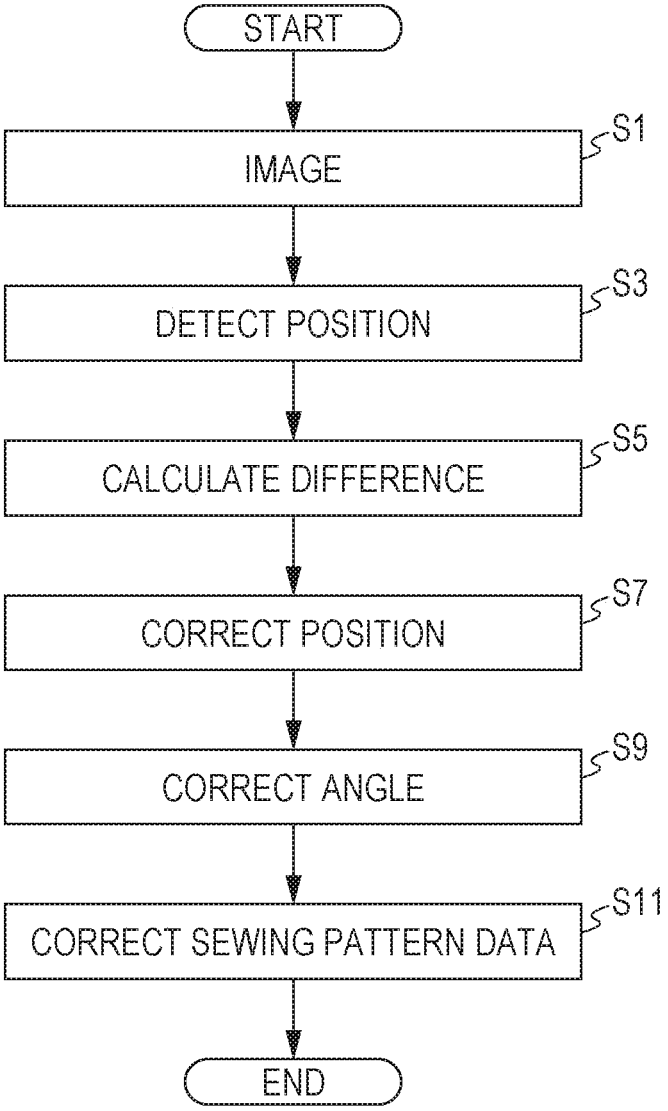
FIG. 6 is an overall flowchart of a sewing pattern data correction process.

FIG. 6 is an overall flowchart of the sewing pattern data correction process. FIG. 7A to FIG. 7D are diagrams illustrating the process in sequence.

As the cloth K is set between the lower plate 61 and the cloth presser 63 using the jig 40, the CPU 121 performs imaging using the camera 13 (step S1). At this point, the X-axis motor 65 and the Y-axis motor 66 are controlled so that the lower plate 61 and the cloth presser 63 are located at prescribed positions of origin.

Figure 7A:
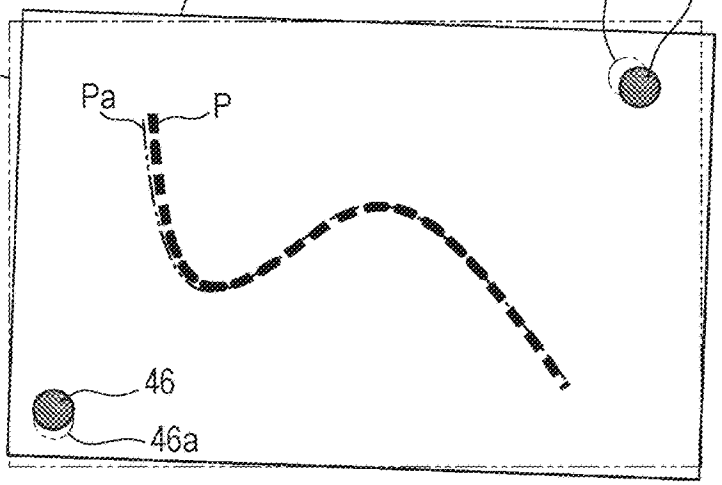
FIG. 7A to FIG. 7D are diagrams illustrating the sewing pattern data correction process in sequence.

FIG. 7A illustrates a captured image of the jig 40 including the first reference mark 46 and the second reference mark 47. In FIG. 7A to FIG. 7D, P indicates the position in which the sewing pattern is formed in the absence of correction of the sewing pattern data 127; and signs 46*a*, 47*a*, 40*a*, Pa indicated by dashed and double-dotted lines respectively indicate, in an X-Y coordinate system of the sewing machine 10 defined for the controller 120, the regular positions (appropriate positions in the absence of position error in the jig 40) of the first reference mark 46, the second reference mark 47, the jig 40, and the sewing pattern P. The regular positions of the first reference mark 46 and the second reference mark 47 are recorded in the sewing pattern data 127 as position coordinate data.

As illustrated in FIG. 7A, it is seen that the jig 40 is in a state of being attached by the lower plate 61 and the cloth presser 63 with a position error from the appropriate position.

Based on the image data captured by the camera 13, the image processing device 15 detects the positions of the first reference mark 46 and the second reference mark 47 (step S3). First, the captured image is searched for the first reference mark 46 and the second reference mark 47. The search may be conducted using a well-known technique, such as pattern matching.

When the positions of the first reference mark 46 and the second reference mark 47 have been detected, the CPU 121 calculates a deviation of each of the first reference mark 46 and the second reference mark 47 separately from a difference of the detected positions with respect to the regular positions 46*a*, 47*a* of the first reference mark 46 and the second reference mark 47 (step S5).

Figure 7B:
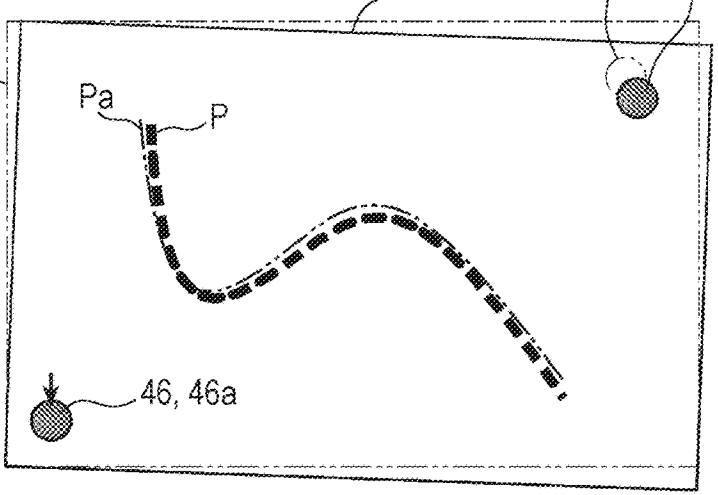

Then, the CPU 121, as illustrated in FIG. 7B, on the basis of the deviation of the first reference mark 46, corrects the detected positions of the first reference mark 46 and the second reference mark 47 in parallel with respect to each of the X-axis direction and the Y-axis direction parallel so that the first reference mark 46 is at the regular position 46*a* (step S7).

Figure 7C:
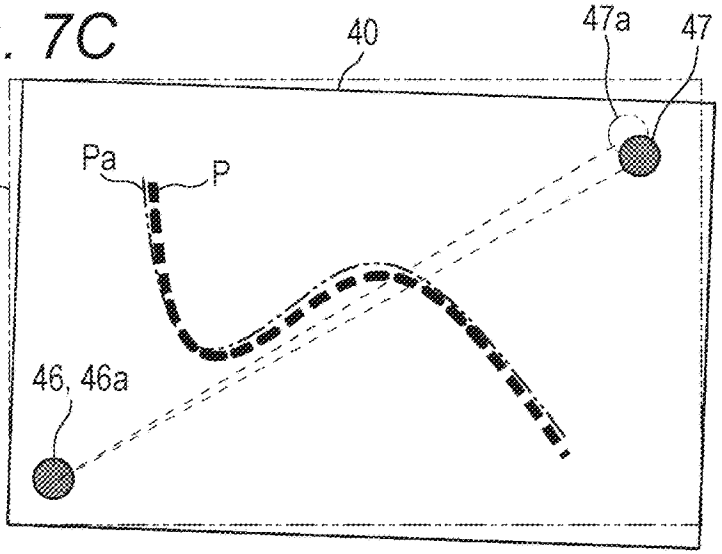
Figure 7D:
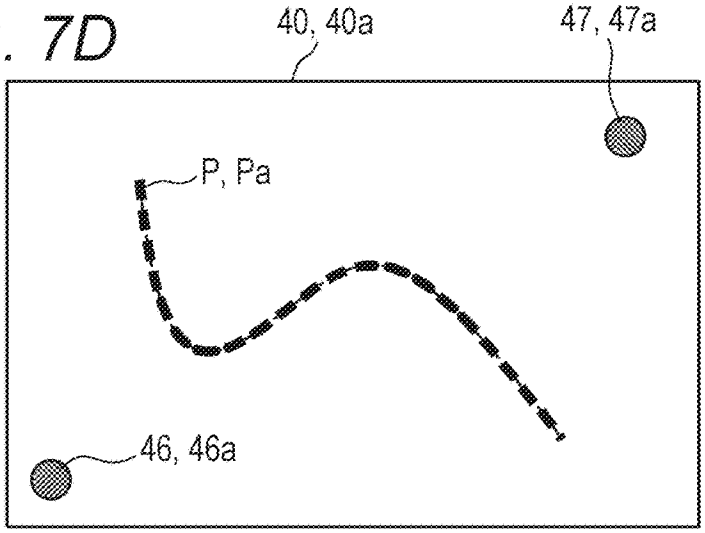

Then, the CPU 121, as illustrated in FIG. 7C, calculates an angular difference between a line segment connecting the first reference mark 46 and the second reference mark 47 after position correction, and a line segment connecting the regular positions 46*a*, 47*a* of the first reference mark 46 and the second reference mark 47.

Further, the CPU 121, on the basis of the angular difference that has been determined, performs an angle correction for making a rotational transfer about the regular position 46*a* of the first reference mark 46 so that the second reference mark 47 after position correction is at the regular position 47*a* of the second reference mark 47 (step S9).

Through the position correction in step S7 and the angle correction in step S9, the position error and angular error of the jig 40 are determined. Thus, the CPU 121, on the basis of these error amounts, corrects the position coordinate data of the needle drop positions defined in the sewing pattern data 127 to positions corresponding to the position error and angular error of the jig 40, thereby creating corrected sewing pattern data (step S11).

By performing sewing in accordance with the corrected sewing pattern data, it becomes possible to perform, with respect to the cloth K being held in the jig 40 having a position error and an angular error, sewing based on the sewing pattern at an appropriate position.

Technical Effects of the Embodiment of the Invention

In the sewing machine 10, the CPU 121 of the controller 120 functions as: the position detector 128 which detects, from the image captured by the camera 13, the positions of the first reference mark 46 and the second reference mark 47 indicating the reference positions marked in the object to be imaged; and the corrector which corrects a plurality of needle drop positions defined in the sewing pattern data 127, on the basis of the deviation of the detected positions of the first reference mark 46 and the second reference mark 47 detected by imaging with respect to the regular positions 46*a*, 47*a* defined in advance for the first reference mark 46 and the second reference mark 47.

Thus, even if an error is caused in the mount position of the jig 40, it is possible to sew the cloth K appropriately in accordance with the sewing pattern.

The CPU 121 of the controller 120 also, as the position detector, detects the positions of the two portions of the first reference mark 46 and the second reference mark 47 from the captured image, and, as the corrector, corrects a plurality of needle drop positions defined in the sewing pattern data on the basis of a deviation of each of the detected positions of the two portions of the first reference mark 46 and the second reference mark 47. Accordingly, it is possible to determine not only the mount position of the jig 40 but also an angular error thereof.

Accordingly, the CPU 121 of the controller 120, as the corrector 129, is able to more accurately correct the position and angle of a plurality of needle drop positions defined in the sewing pattern data 127 on the basis of the deviation of the detected positions of the first reference mark 46 and the second reference mark 47, making it possible to perform better sewing.

The sewing machine 10 is also provided with the jig 40 for holding the cloth K, and the lower plate 61 and the cloth presser 63 hold the cloth K via the jig 40. Accordingly, by setting the cloth K in the jig 40 in advance, sewing can be started quickly. Thus, when a plurality of cloths K is to be sewn, the cloths K may be set in a plurality of jigs 40 in advance, whereby it becomes possible to sew the plurality of cloths K more efficiently.

The CPU 121 of the controller 120 also, as the position detector, detects from the captured image the positions of the first reference mark 46 and the second reference mark 47 attached to the jig 40. Accordingly, the need for attaching a mark to the cloth K is eliminated, thereby reducing operational burden. It also becomes possible to determine the position error and angular error of the jig 40 effectively.

[Others]

While the first reference mark 46 and the second reference mark 47 have been described as the indicators by way of example, there may be one mark or there may be three or more marks.

A mark as the indicator may be provided on the cloth K. In this case, when it is necessary to perform sewing at a predetermined position with respect to the outer shape, it is possible to perform sewing at an appropriate position.

When the cloth K is directly held between the lower plate 61 and the cloth presser 63 without using the jig 40, the cloth presser 63 may be provided with a mark as the indicator.

While the sewing pattern data correction process has been described with reference to the example in which the correction amount is determined each time the cloth K is set between the lower plate 61 and the cloth presser 63 using the jig 40, this does not represent a limitation.

For example, if the cause for mounting error is in the jig 40 per se due to its structure or distortion, the error amount will be approximately the same each time. Accordingly, when a correction amount has been calculated during the sewing pattern data correction process, the correction amount may be stored in the data memory 124 as correction data, and each subsequent correction may be performed on the basis of the correction amount data stored in the memory 124.

If a mounting error occurs for each of a plurality of jigs 40 separately, an identification number may be determined for each jig 40, the correction amount determined in the past for each jig 40 may be stored in the data memory 124, and correction may be performed upon the input of the identification number on the basis of the correction amount determined in the past. In this case, instead of the input of the identification number, a code representation of the identification number that can be read with a sensor or a reader may be attached to the jig 40, and the code may be read at the time of mounting, and correction may be performed on the basis of the correction amount in accordance with the identification number.

While the sewing pattern data correction process has been described as being achieved by the CPU 121 of the controller 120 through a software process, a configuration may be adopted in which, for example, an external processing board or circuit connected to the controller 120 functions as the position detector 128 or the corrector 129.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A sewing machine wherein a stitching needle and a holding frame holding an article to be sewn are positioned relative to each other based on sewing pattern data defining a plurality of needle drop positions, and sewing is performed in accordance with a sewing pattern, the sewing machine comprising:

an imager for capturing an image of the holding frame;

a position detector for detecting, from the image captured by the imager, positions of a plurality of indicators indicating a reference position marked in an object to be imaged;

a corrector which, based on a deviation of the detected positions of the plurality of indicators detected by the position detector with respect to a regular position defined in advance for the plurality of indicators, corrects a plurality of needle drop positions defined in the sewing pattern data; and a jig for holding the article to be sewn, wherein the holding frame holds the article to be sewn via the jig, and the plurality of indicators are disposed on the jig.

2. The sewing machine according to claim 1, wherein the corrector performs position correction and angle correction for the plurality of needle drop positions, defined in the sewing pattern data, on the basis of the deviation of the detected positions of the plurality of indicators.

3. The sewing machine according to claim 1, wherein the position detector detects the position of the indicator attached to the article to be sewn or the holding frame from the captured image.

4. The sewing machine according to claim 1, wherein the plurality of indicators comprises a first indicator and a second indicator, and the first indicator is disposed on a first corner of the jig and the second indicator is disposed on a second corner of the jig that is diagonally spaced apart from the first corner when viewed in a direction perpendicular to an upper surface of the jig.

5. The sewing machine according to claim 1, the jig comprising first flat plate and a second flat plate that hold the article to be sewn in between, wherein the first plate comprises a plurality of positioning projections, the second plate comprises a plurality of first positioning holes at positions respectively corresponding to the plurality of the positioning projections, and the material to be sewn comprises a plurality of second positioning holes at positions respectively corresponding to the plurality of the positioning projections.

6. The sewing machine according to claim 1, the jig comprising a first flat plate and a second flat plate disposed over an upper surface of the first flat plate, wherein the first plate comprises the plurality of indicators on the upper surface of the first plate, and the second plate comprises a plurality of through-holes at positions respectively corresponding to the plurality of the indicators so that the indicators on the upper surface of the first plate are not blocked by the second plate when viewed in a direction perpendicular to an upper surface of the second plate.

7. The sewing machine according to claim 1, further comprising a plurality of the jig each comprising:

a first flat plate, a second flat plate disposed over an upper surface of the first flat plate, and an article to be sewn in between an upper surface of the first plate and a lower surface of the second plate, wherein the first plate comprises the plurality of indicators on the upper surface of the first plate, the second plate comprises a plurality of through-holes at positions respectively corresponding to the plurality of the indicators so that the indicators on the upper surface of the first plate are not blocked by the second plate when viewed in a direction perpendicular to an upper surface of the second plate, one of the plurality of the jigs is set to the sewing machine at a time and the article to be sewn in the jig is sewn at a time, and when the article to be sewn in the one of the plurality of the jig is completed, a next one of the plurality of the jigs is sewn, the process continues successively until all the articles to be sewn in all the jigs are sewn.

8. The sewing machine according to claim 1, the jig comprising a first flat plate and a second flat plate that hold the article to be sewn in between, wherein each of the first flat plate and the second flat plate has a respective opening that has a shape of the sewing pattern defined in sewing pattern data so that the opening disposed on the first flat plate and the opening disposed on the second flat plate are aligned when the first flat plate and the second flat plate are overlapped.

* * * * *